US007485195B2

(12) United States Patent
Sugiura et al.

(10) Patent No.: US 7,485,195 B2
(45) Date of Patent: Feb. 3, 2009

(54) HIGH-STRENGTH HOT-ROLLED STEEL SHEET EXCELLENT IN SHAPE FIXABILITY AND METHOD OF PRODUCING THE SAME

(75) Inventors: Natsuko Sugiura, Futtsu (JP); Manabu Takahashi, Futtsu (JP); Naoki Yoshinaga, Kimitsu (JP); Ken Kimura, Futtsu (JP)

(73) Assignees: Nippon Steel Corporation, Tokyo (JP); Arcelor France, St. Denis (FR)

( * ) Notice: Subject to any disclaimer, the term of this patent is extended or adjusted under 35 U.S.C. 154(b) by 153 days.

(21) Appl. No.: 10/561,133

(22) PCT Filed: Jun. 28, 2004

(86) PCT No.: PCT/JP2004/009465

§ 371 (c)(1),
(2), (4) Date: Dec. 15, 2005

(87) PCT Pub. No.: WO2005/005670

PCT Pub. Date: Jan. 20, 2005

(65) Prior Publication Data

US 2007/0089814 A1 Apr. 26, 2007

(30) Foreign Application Priority Data

Jun. 26, 2003 (JP) ..... 2003-182675
Mar. 26, 2004 (JP) ..... 2004-092280

(51) Int. Cl.

| | |
|---|---|
| ***C22C 38/02*** | (2006.01) |
| ***C22C 38/06*** | (2006.01) |
| ***C22C 38/18*** | (2006.01) |
| ***C22C 38/16*** | (2006.01) |
| ***C22C 38/40*** | (2006.01) |
| ***C21D 8/02*** | (2006.01) |

(52) U.S. Cl. ..... 148/320; 148/330; 148/332; 148/333; 148/334; 148/335; 148/336; 148/602; 148/654; 148/331

(58) Field of Classification Search ..... 148/320, 148/330–336, 602, 654, 601
See application file for complete search history.

(56) References Cited

FOREIGN PATENT DOCUMENTS

| | | |
|---|---|---|
| CN | 1246161 | 3/2000 |
| EP | 1 264 910 | 12/2002 |
| JP | 2001-064750 | 3/2001 |
| JP | 2002 080933 | 3/2002 |
| JP | 2002 097545 | 4/2002 |
| JP | 2002 115025 | 4/2002 |
| JP | 2002 317246 | 10/2002 |
| JP | 2002 322533 | 11/2002 |
| WO | 98/32889 | 7/1998 |
| WO | WO 03/018857 | 3/2003 |
| WO | WO 03/031669 | 4/2003 |

OTHER PUBLICATIONS

Chinese Patent issued Mar. 12, 2008 in corresponding Chinese Patent Application No. CN 200480017463.3.

*Primary Examiner*—Deborah Yee
(74) *Attorney, Agent, or Firm*—Kenyon & Kenyon LLP

(57) ABSTRACT

A high-strength hot-rolled steel sheet excellent in shape fixability having ferrite or bainite as the phase of the largest volume percentage, satisfying all of the following at least at ½ sheet thickness: a mean value of X-ray random intensity ratio in the orientation component group of {100}<011> to {223}<110> to X-ray random diffraction intensity ratio of at least 2.5; a mean value of X-ray random intensity ratio in the three crystal orientation components of {554}<225>, {111}<112>, and {111}<110> to X-ray random diffraction intensity ratio of 3.5 or less; an X-ray intensity ratio to X-ray random diffraction intensity ratio at {100}<011> of at least the X-ray random intensity to X-ray random diffraction intensity ratio at {211}<011>; and an X-ray random intensity ratio to X-ray random intensity ratio diffraction intensity ratio at {100}<011> of at least 2.5, having at least one of an r-value of the rolling direction and an r-value of a direction perpendicular to the rolling direction of not more than 0.7, having an anisotropy ΔuE1 of uniform elongation of not more than 4%, having an anisotropy ΔLE1 of local elongation of at least 2%, and having an ΔuE1 of not more than the ΔLE1.

10 Claims, No Drawings

HIGH-STRENGTH HOT-ROLLED STEEL SHEET EXCELLENT IN SHAPE FIXABILITY AND METHOD OF PRODUCING THE SAME

TECHNICAL FIELD

The present invention relates to a high-strength hot-rolled steel sheet excellent in shape fixability used for an automobile part etc. and able to efficiently achieve a reduction in weight of an automobile part and a method of producing the same.

BACKGROUND ART

To suppress the emission of carbon dioxide gas from automobiles, high-strength steel sheet is being used to reduce the weight of automobile body. Further, to secure the safety of passengers, not only soft steel sheet, but also high-strength steel sheet is being made much use of for automobile body. In addition, to reduce the weight of automobile body in the future, new demand is rapidly rising for raising the level of usage strength of high-strength steel sheet.

However, when bending deformation is applied to high-strength steel sheet, because of the high strength, the "spring back" phenomenon of the shape after the work tending to deviate from the shape of the forming jig and return in the direction of the shape before the work and the "wall camber" phenomenon of the planes of the side walls ending up as surfaces having curvature due to elastic recovery as a result of bending-rebending during work occur.

Therefore, in a conventional automobile bodies, the steel used has mainly been limited to high-strength steel sheet of less than 440 MPa strength. For automobile body, it is necessary to use high-strength steel sheet of more than 490 MPa strength to reduce the weight of the body. Despite this, there is no high-strength steel sheet with little spring back and wall camber and a good shape fixability.

Without having to say it, rising the shape fixability after working high-strength steel sheet or soft steel sheet of less than 440 MPa strength is extremely important in raising the shape precision of automobiles, household electric appliances, and other products.

Some of the inventors disclosed in WO 00/06791 a ferritic thin steel sheet with a ratio of the {100} plane and {111} plane of at least 1 for the purpose of improving the shape fixability, but the patent document has no description of reduction of the wall camber. Therefore, the X-ray intensity ratio in the orientation component group of {100}<011> to {223}<110> to the X-ray random diffraction intensity ratio and those in the orientation components of {100}<011> are not described either in the patent document.

Further, some of the inventors disclosed in Japanese Unexamined Patent Publication (Kokai) No. 2001-64750, as technology for reducing the amount of spring back, a cold-rolled steel sheet wherein the reflected X-ray intensity ratio of a {100} plane parallel to the sheet plane is controlled to 3 or more. However, this cold rolled steel sheet is characterized by specifying the x-ray intensity ratio at the outermost surface in the sheet thickness, so is steel sheet completely different from the present invention.

Further, some of the inventors disclosed in Japanese Unexamined Patent Publication (Kokai) No. 2002-363695 and Japanese Patent Application No. 2002-286838 (Japanese Unexamined Patent Publication (Kokai) No. 2004-124123) a low yield ratio high-strength steel sheet excellent in shape fixability and a method of producing the same.

Compared with these inventions, the present invention studies the production conditions whereby a more excellent shape fixability is realized and production conditions whereby both a shape fixability and workability are obtained.

That is, the inventors discovered that for this, control of the texture and control of the anisotropy of ductility are extremely important and, as result of intensive study, discovered optimal control conditions satisfying these requirements.

SUMMARY OF THE INVENTION

If increasing the strength of steel sheet applied for automobile parts to be subject to bending, the amount of spring back increases along with the rise of the steel sheet strength and shape defects occur, so use of high-strength steel sheet is limited at the present time.

Further, excellent press formability and high impact energy absorbability are essential properties for application of high-strength steel sheet to auto parts etc.

The present invention fundamentally solves the problem and provides a high-strength hot-rolled steel sheet having an excellent shape fixability and a method of producing the same.

According to conventional knowledge, as a means for reducing the amount of spring back and suppressing shape fixation defects, lowering of the yield point of the steel sheet had been considered important. Further, to reduce the yield point, steel sheet with a low tensile strength had to be used.

However, this alone is not a fundamental means of solution for improving the bendability of a steel sheet, reducing the amount of spring back, and reducing shape fixation defects.

Therefore, the inventors took note of the effect of the texture of the steel sheet on the bendability and engaged in a detailed investigation and research on its action and effects so as to improve the bendability and fundamentally solve the problem of the occurrence of shape fixation defects. As a result, they discovered a steel sheet excellent in shape fixability.

That is, the inventors found that by controlling the X-ray intensity ratio in the orientation component group of {100}<011> to {223}<110> to X-ray random diffraction intensity, in particular in the orientation components of {100}<011> and the orientation components of {111}<112> and {111}<110>, and by making at least one of the r-value of the rolling direction and the r-value of the direction perpendicular to the rolling direction as low a value as possible and by making the anisotropy of local elongation at least 2%, the bendability is strikingly improved.

However, if the anisotropy of local elongation becomes larger, the elongated flange formability is expected to deteriorate and achievement of both a shape fixability and formability becomes difficult. Therefore, the inventors engaged in intensive studies and as a result discovered that simultaneous achievement of texture control and carbide control enables the shape fixability to be raised.

Further, since a multi-phase steel is effective in order to maintain an excellent press formability and a high impact absorbability, the inventors found out the most preferable conditions for hot-rolling from viewpoint of texture control and microstructure control.

Further, not limiting the direction of cutting blanks for forming various parts greatly contributes to the improvement of the yield of the steel material. For this, the anisotropy of ductility, in particular the reduction of the anisotropy of uniform elongation, has important significance.

The inventors discovered by experiments that by controlling the start temperature and end temperature of finishing hot-rolling of steel sheet, it is possible to cause development of the {100}<011> orientation component as the principal orientation component and thereby secure the above shape fixability and formability while reducing the anisotropy of uniform elongation.

The present invention was made based on the above findings and has as its gist the following:

(1) A high-strength hot-rolled steel sheet excellent in shape fixability, wherein ferrite or bainite is the maximum phase in terms of percent volume, satisfying all of the following at least at ½ of the sheet thickness:

(i) a mean value of X-ray random intensity ratios of a group of {100}<011> to {223}<110> orientations is 2.5 or more, (ii) a mean value of X-ray random intensity ratio of three orientations of {554}<225>, {111}<112>, {111}<110> is 3.5 or less, (iii) X-ray random intensity ratio of {100}<011> is larger than that of {211}<011>, (iv) X-ray random intensity ratio of {100}<011> is 2.5 or more, having at least one of an r-value in a rolling direction and the r-value in a direction perpendicular to the rolling direction is 0.7 or less, having anisotropy of uniform elongation ΔuE1 is 4% or less, having an anisotropy of local elongation ΔLE1 is 2% or more, and having an ΔuE1 which is ΔLE1 or less, where:

$$\Delta uE1=\{|uE1(L)-uE1(45°)|+|uE1(C)-uE1(45°)|\}/2$$

$$\Delta LE1=\{|LE1(L)-LE1(45°)|+|LE1(C)-LE1(45°)|\}/2$$

uE1 (L): Uniform elongation in a rolling direction
uE1 (C): Uniform elongation in a transverse direction
uE1 (45°): Uniform elongation in a 45° direction
LE1 (L): Local elongation in a rolling direction
LE1 (C): Local elongation in a transverse direction
LE1 (45°): Local elongation in a 45° direction.

(2) A high-strength hot-rolled steel sheet excellent in shape fixability as set forth in (1), characterized in that an occupancy rate of iron carbide, diameter of which is 0.2 μm or more, is 0.3% or less.

(3) A high-strength hot-rolled steel sheet excellent in shape fixability as set forth in (1), characterized in that an aging index A.I. is 8 MPa or more.

(4) A high-strength hot-rolled steel sheet excellent in shape fixability as set forth in (1), characterized by containing, in terms of weight %, C: 0.01 to 0.2%,
Si: 0.001 to 2.5%,
Mn: 0.01 to 2.5%,
P: 0.2% or less,
S: 0.03% or less,
Al: 0.01 to 2%,
N: 0.01% or less, and
O: 0.01% or less and remainder Fe and unavoidable impurities.

(5) A high-strength hot-rolled steel sheet excellent in shape fixability as set forth in (4), characterized by further containing at least one or more element selected from Nb, Ti and V with a total of 0.001 to 0.8%, in terms of weight %.

(6) A high-strength hot-rolled steel sheet excellent in shape fixability as set forth in (4) or (5), characterized by further containing at least one or more, in terms of weight %, B: 0.01% or less,
Mo: 1% or less,
Cr: 1% or less,
Cu: 2% or less,
Ni: 1% or less,
Sn: 0.2% or less,
Co: 2% or less,
Ca: 0.0005 to 0.005%,
Rem: 0.001 to 0.05%,
Mg: 0.0001 to 0.05%,
Ta: 0.0001 to 0.05%.

(7) A high-strength hot-rolled steel sheet excellent in shape fixability as set forth in (1), characterized by containing, in terms of weight %, C: 0.02 to 0.3%, at least one or more element selected from the following group consisting of, total 0.1 to 3.5%, in terms of weight %, Mn: 0.05 to 3%,
NI: 3% or less,
Cr: 3% or less,
Cu: 3% or less,
Mo: 1% or less,
Co: 3% or less and
Sn: 0.2% or less, at least one or both consisting of, total 0.02 to 3% in terms of weight %, Si: 3% or less and
Al: 3% or less and remainder Fe and unavoidable impurities, and having multi-phase structure, wherein ferrite or bainite is the maximum phase in terms of percent volume, and a percent volume of martensite is 1 to 25%.

(8) A high-strength hot-rolled steel sheet excellent in shape fixability as set forth in (7), characterized by containing, in terms of weight %, at least one or more element selected from Nb, Ti and V with a total of 0.001 to 0.8%, in terms of weight %.

(9) A high-strength hot-rolled steel sheet excellent in shape fixability as set forth in (7) or (8), characterized by further containing at the least of one or more element selected from the following group consisting of, in terms of weight %, P: 0.2% or less,
B: 0.01% or less,
Ca: 0.0005 to 0.005% and
Rem: 0.001 to 0.02%

(10) A high-strength hot-rolled steel sheet excellent in shape fixability as set forth in (4) or (5), wherein the steel sheet is plated.

(11) A high-strength hot-rolled steel sheet excellent in shape fixability as set forth in (7) or (8), wherein the steel sheet is plated.

(12) A method of producing a high-strength hot-rolled steel sheet excellent in shape fixability comprising the following steps, hot-rolling a cast slab having a composition as set forth in (4) or (5) as cast cooled once, then reheated to a temperature range of 1000-1300° C., with a total reduction rate of 25% or more at $Ar_3$ to ($Ar_3$+150)° C., temperature at finishing hot-rolling start, TFS, and temperature at finishing hot-rolling end, TFE, simultaneously satisfies following Equations (1) to (4), and cooling hot-rolled steel sheet, then coiling at below critical temperature $T_0$ determined by the chemical composition of the steel sheet shown in the following Equation (5) and a temperature of 400 to 700° C., $$TFE \geqq Ar_3 \quad (1)$$

$$TFE \geqq 800° C. \quad (1')$$

$$TFS \leqq 1100° C. \quad (2)$$

$$20° C. \leqq TFS - TFE \leqq 120° C. \quad (4)$$

$$T_0 = -650.4 \times \{C\%/(1.82 \times C\% - 0.001)\} + B \quad (5)$$

where B is found from the composition of the steel expressed by weight %

$$B = -50.6 \times Mneq + 894.3$$

$$Mneq = Mn\% + 0.24 \times Ni\% + 0.13 \times Si\% + 0.38 \times Mo\% + 0.55 \times Cr\% + 0.16 \times Cu\% - 0.50 \times Al\% - 0.45 \times Co\% + 0.90 \times V\%$$

$$Ar_3 = 901 - 325 \times C\% + 33 \times Si\% + 287 \times P\% + 40 \times Al\% - 92 \times (Mn\% + Mo\% + Cu\%) - 46 \times (Cr\% + Ni\%)$$

(13) A method of producing a high-strength hot-rolled steel sheet excellent in shape fixability as set forth in (12) characterized by further controlling a friction coefficient to not more than 0.2 in at least one pass in the hot-rolling in a temperature range of $Ar_3$ to $(Ar_3+150)°$ C.

(14) A method of producing a high-strength hot-rolled steel sheet excellent in shape fixability characterized by applying skin pass rolling of 0.1 to 5% to hot-rolled steel sheet produced by the method of producing a high-strength hot-rolled steel sheet excellent in shape fixability as set forth in (12).

(15) A method of producing a high-strength hot-rolled steel sheet excellent in shape fixability comprising the following steps, hot-rolling a cast slab having a composition as set forth in (7) or (8) as cast or cooled once, then reheated to a range of 1000 to 1300° C., with a total reduction ratios of 25% or more at $Ar_3$ to $(Ar_3+150)°$ C., temperature at finishing hot-rolling start, TFS, and temperature at finishing hot-rolling end, TFE, and calculated residual strain $\Delta\epsilon$ to simultaneously satisfy following relations (1) to (4), and cooling hot-rolled steel sheet, then coiling at below critical temperature $T_0$ determined by the chemical composition of the steel shown in the following relation (5) and a temperature of not more than 400° C.:

$$TFE \geqq Ar_3 (° C.) \quad (1)$$

$$TFS \leqq 1100° C. \quad (2)$$

$$\Delta\epsilon \geqq (TFS - TFE)/375 \quad (3)$$

$$20° C. \leqq (TFS - TFE) \leqq 120° C. \quad (4)$$

$$T_0 - 650.4 \times \{C\%/(1.82 \times C\% - 0.001)\} + B \quad (5)$$

where, B is found from the composition of the steel expressed by weight %, $$B = -50.6 \times Mneq + 894.3$$

$$Mneq = Mn\% + 0.24 \times Ni\% + 0.13 \times Si\% + 0.38 \times Mo\% + 0.55 \times Cr\% + 0.16 \times Cu\% - 0.50 \times Al\% - 0.45 \times Co\% + 0.90 \times V\%$$

where, $$Ar_3 = 901 - 325 \times C\% + 33 \times Si\% + 287 \times P\% + 40 \times Al\% - 92 \times (Mn\% + Mo\% + Cu\%) - 46 \times (Cr\% + Ni\%)$$

$\Delta\epsilon$ is found from the equivalent strain $\epsilon i$ (i is 1 to n) given at each stand of the n stages of finishing rolling for the rolling, time ti (sec) (i=1 to n−1) between stands, time tn (sec) from the final stand to the start of cooling, rolling temperature Ti(K) (i=1 to n) at each stand, and a constant R=1.987.

$$\epsilon = \Delta\epsilon 1 + \Delta\epsilon 2 + \cdots + \Delta\epsilon n$$

$$\text{where, } \Delta\epsilon i = \epsilon i \times \exp\{-(ti^*/\tau n)^{2/3}\}$$

$$\tau i = 8.46 \times 10^{-9} \times \exp\{43800/R/Ti\}$$

$$ti^* = \tau n \times (ti/\tau i + t(i+1)/\tau(i+1) + \ldots + tn/\tau n\}$$

(16) A method of producing a high-strength hot-rolled steel sheet excellent in shape fixability as set forth in (15) characterized by further controlling a friction coefficient to not more than 0.2 in at least one pass in the hot-rolling in a temperature range of $Ar_3$ to $(Ar_3+150)°$ C.

(17) A method of producing a high-strength hot-rolled steel sheet excellent in shape fixability characterized by applying skin pass rolling of 0.1 to 5% to hot-rolled steel sheet produced by the method of producing a high-strength hot-rolled steel sheet excellent in shape fixability as set forth in (15).

THE MOST PREFERRED EMBODIMENT

Below, the content of the present invention will be explained in detail.

Mean Value of X-ray Random Intensity Ratios of Group of {100}<011> to {223}<110> at Sheet Plane at ½ Sheet Thickness:

The average value of the {100}<011> to {23}<110> orientation component group when performing X-ray diffraction for the sheet plane at the sheet thickness center position and finding the ratio of intensity in the different orientation components to a random sample has to be at least 2.5. If this average value is less than 2.5 or less, the shape fixability becomes poor.

The main orientation components included in the orientation component group are {100}<011>, {116}<110>, {114}<110>, {113}<110>, {112}<110>, {335}<110>, and {223}<110>.

The X-ray random intensity ratio in these orientation components to X-ray random diffraction intensity may be found from the three-dimensional texture calculated by the vector method based on a {110} pole figure or the series expansion method using a plurality (desirably three or more) of pole figures out of the pole figures of {110}, {100}, {211}, and {310}.

For example, for the X-ray random intensity ratio in the above crystal orientation components to X-ray random diffraction intensity calculated by the latter method, the intensities of (001)[1-10], (116)[1-10], (114)[1-10], (113)[1-10], (112)[1-10], (335)[1-10], and (223)[1-10] at a $\phi 2=45°$ cross-section in a three-dimensional texture can be used without modification.

The average value in the orientation component group of {100}<011> to {223}<110> is the arithmetic average ratio of all the above orientation components. When it is impossible to obtain the intensities in all these orientation components, the arithmetic average of the intensities in the orientation components of {100}<011>, {116}<110>, {114}<110>, {112}<110> and {223}<110> may be used as a substitute.

Further, preferably the average value of the X-ray random intensity ratio in the orientation component group of {100}<011> to {223}<111> to X-ray random diffraction intensity is 4.0 or more.

Mean Value of X-ray Random Intensity Ratio in Three Crystal Orientation Components of {554}<225>, {111}<112>, and {111}<110> at Sheet Plane at ½ Sheet Thickness:

The mean value of the X-ray random intensity ratio in the three crystal orientation components of {554}<225>, {111}<112>, and {111}<110> to X-ray random diffraction intensity at the sheet plane at ½ sheet thickness shall be 3.5 or less. If this mean value is 3.5 or more, even if the intensity in the orientation component group of {100}<011> to {223}<110> is appropriate, a good shape fixability becomes difficult to obtain.

The X-ray random intensity ratio at {554}<225>, {111}<112>, and {111}<110> to X-ray random diffraction intensity can be calculated from the three-dimensional texture calculated in accordance with the above method.

Further, preferably the arithmetic average of the X-ray random intensity ratio at {554}<225>, {111}<112>, and {111}<110> to random X-ray diffraction intensity is 2.5 or less.

X-ray Random Intensity Ratio at {100}<011> and {211}<011> at Sheet Plane at ½ Sheet Thickness:

The X-ray random intensity ratio at {100}<011> to X-ray random diffraction intensity at the sheet plane at ½ sheet thickness must be at least the X-ray random intensity at {211}<011> to X-ray random diffraction intensity. If the X-ray random intensity ratio at {211}<011> to X-ray random diffraction intensity becomes larger than the X-ray random intensity ratio at {100}<011> to X-ray random diffraction intensity, the anisotropy of uniform elongation becomes greater and the formability deteriorates.

Note that the {100}<011> and {211}<011> mentioned here allow as the range of orientation having similar effects ±12° using the direction perpendicular to the rolling direction (transverse direction) as the axis of rotation, more preferably ±16°.

The reason why the X-ray intensity in the crystal orientation components explained above are important for a shape fixability in bending or the anisotropy of elongation is not necessarily clear, but it is estimated that the sliding behavior of crystals during bending deformation has some connection.

The sample used for X-ray diffraction is prepared by reducing a steel sheet to a predetermined sheet thickness by mechanical polishing etc., then removing the strain and simultaneously making the sheet thickness ½ plane the measurement plane by chemical polishing, electrolytic polishing, etc.

When there is a segregation zone, defects, etc. in the center layer of sheet thickness of the steel sheet and problems occur in measurement, measurement may be made by adjusting the sample in accordance with the above method so that a suitable plane becomes the measurement plane in the range of ⅜ to ⅝ sheet thickness.

Only naturally, if the limitation of the X-ray intensities is satisfied not only near ½ sheet thickness, but for as great a number of thicknesses as possible (in particular, from the outermost layer to ¼ sheet thickness), the shape fixability becomes even better.

Note that the crystal orientation component expressed by {hkl}<uvw> shows that the normal direction of the sheet plane is parallel to <hkl> and the rolling direction is parallel to <uvw>.

r-value (rL) of Rolling Direction and r-value of Direction Perpendicular to Rolling Direction (rC):

Both of the above r-values are important in the present invention. That is, the inventors engaged in intensive studies and as a result learned that even if the X-ray intensities of the above crystal orientation components are suitable, a good shape fixability can not necessarily be obtained.

At the same time as the above X-ray intensities, it is essential that at least one of the rL and rC be 0.7 or less, more preferably be 0.55 or less.

The effect of the present invention can be obtained without particularly limiting the lower limits of rL and rC. The r-value is evaluated by a tensile test using a JIS No. 5 tensile test piece.

The tensile strain is normally 15%, but when the uniform elongation is less than 15%, it should be evaluated by a strain as close to 15% as possible in the range of the uniform elongation.

Note that the direction of the bending differs depending on the worked part, so is not particularly limited, but it is preferable to mainly work the sheet bending it vertical or in a direction close to the vertical with respect to the direction of the small r-value.

However, in general, it is known that the texture and r-values have correlation, but in the present invention, limitation relating to the ratio of the X-ray intensities in the crystal orientation components to X-ray random diffraction intensity and limitation relating to the r-values are not synonymous. Without the two limitations being simultaneously satisfied, a good shape fixability cannot be obtained.

Anisotropy of Ductility:

When press forming steel sheet, the uniform elongation of the steel sheet, that is, the n-value, has important meaning. In particular, in high-strength steel sheet mainly for punch stretch forming, when the uniform elongation (n-value) has anisotropy, it is necessary to carefully select the direction of cutting out the blanks according to the part and a deterioration of the productivity and drop in the yield of the steel sheet are invited.

Further, in some cases, the sheet cannot be formed into the desired shape.

In steel having a tensile strength of more than about 400 MPa (maximum strength obtained in tensile strength), if the anisotropy ΔuE1 of uniform elongation is 4% or less, it is learned that a good formability is exhibited not dependent on the direction.

When a particularly strict formability is required, the anisotropy ΔuE1 is preferably not more than 3%.

The lower limit of the anisotropy ΔuE1 of uniform elongation is not particularly limited, but making it 0% is the most preferable from the viewpoint of the formability.

Further, if the anisotropy ΔLE1 of local elongation becomes less than 2%, the shape fixability deteriorates, so the lower limit of ΔLE1 is made 2%. The upper limit of ΔLE1 is not particularly set, but if ΔLE1 becomes too large, the formability declines, so the upper limit is preferably made 12%.

However, even if satisfying the above conditions, when ΔuE1>ΔLE1, a good formability and shape fixability are not simultaneously achieved, so ΔuE1 was made not more than ΔLE1.

Note that the anisotropies of uniform elongation and local elongation are defined as follows using the elongations parallel to the rolling direction (L direction), vertical (C direction), and 45° direction:

$$\Delta uE1=\{|uE1(L)-uE1(45°)|+|uE1(C)-uE1(45°)|\}/2$$

$$\Delta LE1=\{|LE1(L)-LE1(45°)|+|LE1(C)-LE1(45°)|\}/2.$$

Microstructure:

In actual auto parts, the shape fixability due to the above bending is not the only problem in a part. Other locations in the same part sometimes are subjected to elongated flange, burring, or other work, so there are quite a few cases where punch stretch forming, restriction, or other good press formability is sought.

Therefore, along with improvement of the shape fixability at the time of bending for controlling the texture, the hole expansivity and press formability of the steel sheet itself also have to be improved.

From this viewpoint, the microstructure of the steel sheet should be one having the ferrite or bainite phase having a high hole expansivity as the phase of the largest volume percentage. However, from the viewpoint of the texture, a bainite phase produced by transformation at a low temperature results in stronger development of the texture, so it is preferable to make bainite the principal phase.

Note that the bainite spoken of here may or may not include iron carbide particles in the microstructure. Further, the ferrite worked after transformation and having an extremely high internal dislocation density (worked ferrite) causes the ductility to remarkably deteriorate and is not suited for working of parts, so is differentiated from the ferrite defined in the present invention.

Further, the inventors discovered that the characteristic of the steel of the present invention includes at least 1% martensite in the steel sheet to lower the yield ratio is most preferable at least one of rL and rC be not more than 0.7 and for satisfying for improving the punch stretch formability.

At this time, if the volume percentage of martensite exceeds 25%, not only is the strength of the steel sheet improved more than necessary, but also the ratio of the martensite linked in a network increases and the formability of the steel sheet is remarkably deteriorated, so 25% was made the maximum value of the volume percentage of martensite.

Further, to obtain the effect of the reduction of the yield ratio by the martensite, when the phase of the largest volume percentage is ferrite, it is preferable that the value be at least 3%, while when the phase of the largest volume percentage is bainite, it is preferable that the value be at least 5%.

Further, when the phase of the largest volume percentage is other than ferrite or bainite, the strength of the steel material is improved more than necessary and the formability is deteriorated or the precipitation of unnecessary carbides makes it impossible to secure the necessary amount of martensite and thereby the formability of the steel sheet is remarkably deteriorated, so the phase of the largest volume percentage is limited to ferrite or bainite.

Further, even if residual austenite not finished transforming is contained at the time of cooling down to room temperature, there will not be any great effect on the effect of the present invention. However, if the volume percentage of the residual austenite found by the reflected X-ray method etc. increases, the yield ratio rises, so the volume percentage of the residual austenite is preferably not more than two times the volume percentage of the martensite and more preferably not more than the volume percentage of the martensite.

Further, the rate of occupancy of iron carbide of a diameter of 0.2 μm or more causing the elongated flange formability to remarkably deteriorate is preferably limited to 0.3% or less. The rate of occupancy of the iron carbide may also be replaced by finding the percent area of the iron carbide by image processing in an optical microscope photograph of at least ×500 magnification. Further, it is also possible to find the m number of lattice points occupied by iron carbide of 0.2 μm or more among the n number of lattice points drawn on the photograph and use m/n as the rate of occupancy.

Aging Index AI:

The index A.I. showing the aging of steel sheet is preferably at least 8 MPa. If A.I. becomes less than 8 MPa, the shape fixability falls, so 8 MPa is made the lower limit. The reason why the shape fixability deteriorates if the A.I. falls is not clear, but the A.I. is correlated with the movable dislocation density in steel sheet, so the difference in the movable dislocation density is believed to have some sort of effect on the deformation.

The upper limit of the A.I. is not particularly limited, but if the A.I. becomes more than 100 MPa, stretcher strain occurs and the appearance of the steel sheet is liable to be remarkably damaged, so the A.I. is preferably not more than 100 MPa.

Note that the aging index is measured by using an L direction or C direction JIS No. 5 tensile test piece and using the difference between the deformation stress when applying a prestrain of 10% and the yield stress when removing the load once, aging at 100° C. for one hour, then conducting the tensile test again (when yield elongation occurs, the lower yield stress) as the aging index A.I.

Next, the preferable chemical composition of the present invention will be explained. Note that the units are mass %.

First, the chemical composition of high-strength hot-rolled steel sheet having a microstructure of ferrite or bainite as the phase of the largest volume percentage and excellent in shape fixability will be explained. Note that in the above steel sheet, the hole expansivity is also excellent.

C:

The lower limit of C was made 0.01% because with a C of less than 0.01%, it is difficult to secure the strength of the steel sheet while maintaining a high formability. On the other hand, if over 0.2%, the austenite phase or martensite phase and rough carbides lowering the hole expansivity are easily formed and further the weldability also falls, so the upper limit is made 0.2%.

Si:

Si is an effective element for raising the mechanical strength of the steel sheet, but if over 2.5%, the formability deteriorates or surface flaws occur, so 2.5% is made the upper limit. On the other hand, in actual steel, it is difficult to make the Si less than 0.001%, so 0.001% is made the lower limit.

Mn:

Mn is an effective element for raising the mechanical strength of the steel sheet, but if over 2.5%, the formability deteriorates, so 2.5% is made the upper limit. On the other hand, in actual steel, it is difficult to make the Mn less than 0.01%, so 0.01% is made the lower limit.

Further, other than Mn, when Ti and other elements for suppressing the occurrence of hot cracking due to the S are not sufficiently added, it is desirable to add an amount of Mn giving, by mass %, Mn/s≧20.

P, S:

P and S are added in amounts of not more than 0.2% and 0.03%. This is to prevent deterioration of the formability or cracking at the time of hot-rolling or cold rolling.

Al:

Al is added in an amount of at least 0.01% for deoxidation. However, if too great, the formability declines and the surface properties deteriorate, so the upper limit is made 2.0%.

N, O:

These are impurities. To prevent deterioration of the formability, the amounts of N and O are made not more than 0.01% and not more than 0.01%, respectively.

Ti, Nb, V:

These elements are elements which improve the material quality through mechanisms such as precipitation strengthening, texture control, granular strengthening, etc. In accordance with need, it is preferable to add one or more types to a total of at least 0.001%.

However, even if excessively added, there is no remarkable effect. Rather, the formability and surface properties are caused to deteriorate, so a total of 0.8% of the one or more types is made the upper limit.

B:

B is effective for strengthening the grain boundary and raising the strength of the steel material, but if the amount added exceeds 0.01%, not only is the effect saturated, but also the strength of the steel sheet is raised more than necessary and the formability to a part is caused to drop, so the upper limit was made 0.01%. However, to obtain the effect of addition of B, it is preferable to add at least 0.002%.

Mo, Cr, Cu, Ni, Sn, Co:

These elements have the effect of raising the mechanical strength or improving the material quality, so it is preferable to add at least 0.001% for each element in accordance with need. However, excessive addition causes the formability to deteriorate, so the upper limits of Mo, Cr, Cu, Ni, Sn, and Co are made 1%, 1%, 2%, 1%, 0.2%, and 2%.

Ca, Rem:

These elements are effective elements for control of inclusions, so suitable addition improves the hot formability, but excessive addition conversely aggravates the hot embrittlement, so the amounts of Ca and Rem were made 0.0005% to 0.005% and 0.001% to 0.05% in accordance with need. Here, the "rare earth elements" mean Y, Sr, and lanthanoid elements and industrially are mixtures of the same.

Further, adding Mg in an amount of 0.0001% to 0.05% and Ta in an amount of 0.001% to 0.05% also give equivalent effects.

Here, in all cases, the lower limit indicates the minimum amount added for expressing the inclusion control effect. Above the maximum value, conversely the inclusions grow too large, so the elongated flange formability and other aspects of the hole expansivity are reduced. Addition as misch metal (mixture) is advantageous cost wise.

Next, the chemical composition of high-strength hot-rolled steel sheet having a multi-phase structure of a microstructure of ferrite or bainite as the phase of the largest volume percentage and including martensite having a volume percentage of 1 to 25% and excellent in shape fixability will be explained.

Note that the above steel sheet is a low yield ratio steel sheet.

C:

C is the most important element determining the strength of a steel material. The volume percentage of the martensite contained in the steel sheet tends to increase along with a rise in the C concentration in the steel sheet. Here, when the amount of C added is less than 0.02%, it becomes difficult to obtain hard martensite, so 0.02% was made the lower limit of the amount of C added.

Further, if the amount of C added exceeds 0.3%, not only does the strength of the steel sheet rise more than necessary, but also the weldability, an important characteristic for a steel material for an automobile, remarkably deteriorates, so 0.3% was made the upper limit of the amount of C added.

Mn, Ni, Cr, Cu, Mo, Co, and Sn:

Mn, Ni, Cr, Cu, Mo, Co, and Sn are all added to adjust the microstructure of the steel material. In particular, when the amount of C added is limited from the viewpoint of the weldability, addition of suitable amounts of these elements is effective for effectively adjusting the hardenability of the steel.

Further, these elements, while not to the extent of Al and Si, have the effect of suppressing the production of cementite and can effectively control the martensite volume percentage. Further, these elements have the function of raising the dynamic deformation resistance at a high speed by strengthening by solid solution the matrix ferrite or bainite along with the Al and Si.

However, when the total of the amounts added of the one or more of these elements is less than 0.1% or the content of Mn is less than 0.05%, it is no longer possible to secure the required volume percentage of martensite, the strength of the steel material becomes lower, and effective reduction of the weight of the bodies can no longer be achieved, so the lower limit of the Mn content was made 0.05% and the lower limit of the total of the amounts of the one or more of the above elements added was made 0.1%.

On the other hand, when the total of the above amounts of addition exceeds 3.5%, when the content of any of Mn, Ni, Cr, Cu, and Co exceeds 3%, when the content of Mo exceeds 1%, or when the content of Sn exceeds 0.2%, hardening of the matrix ferrite or bainite is invited and a decline in the formability of the steel material, a decline in the toughness, and a rise in the cost of the steel material are invited, so the upper limit of the total of the amounts added was made 3.5%, the upper limits of the content of Mn, Ni, Cr, Cu, and Co were made 3%, the upper limit of the content of Mo was made 1%, and the upper limit of the content of Sn was made 0.2%.

Al, Si:

Al and Si are both ferrite stabilizing elements and act to improve the formability of the steel material by increasing the ferrite volume percentage. Further, Al and Si suppress the production of cementite, so can suppress the production of the bainite or other phase including carbides and can effectively cause the production of martensite.

As the added elements having these functions, in addition to Al and Si, P or Cu, Cr, Mo, etc. may be mentioned. Suitable addition of these elements also may be expected to give rise to similar effects.

However, when the total of the Al and Si is less than 0.05%, the effect of suppression of the production of cementite is not sufficient and a suitable volume percentage of martensite cannot be obtained, so the lower limit of the total of one or both of Al and Si was made 0.05%.

Further, when the total of one or both of Al and Si exceeds 3%, hardening or embrittlement of the matrix ferrite or bainite is invited, a decline in the formability of the steel material, a decline in the toughness, and a rise in the cost of the steel material are invited, and the chemical treatability and other surface treatment characteristics remarkably deteriorate, so 3% was made the upper limit of one or both of Al and Si.

Nb, Ti, V:

These elements improve the material quality through mechanisms such as fixing of carbon and nitrogen, precipitation strengthening, texture control, granular strengthening, etc. In accordance with need, it is preferable to add one or more types to a total of at least 0.001%. Further, by adding Nb or Ti, a texture advantageous to the shape fixability easily is formed in the hot-rolling, so it is preferable to actively utilize this. However, excessive addition causes the formability to deteriorate, so 0.8% was made the upper limit of the total of the one or more elements added.

P:

P is effective for raising the strength of the steel material and, as explained above, for securing the martensite, but if added over 0.2%, deterioration of the season crack resistance or deterioration of the fatigue characteristic and toughness is invited, so 0.2% was made the upper limit. However, to obtain the effect of addition, inclusion in an amount of 0.005% or more is preferable.

B:

B is effective for strengthening the grain boundary and raising the strength of the steel material, but if exceeding 0.01%, not only is the effect saturated, but also the strength of the steel sheet is raised more than necessary and the formability to a part is caused to drop, so the upper limit was made 0.01%. However, to obtain the effect of addition, it is preferable to contain at least 0.0005%.

Ca, Rem:

These elements improve the elongated flange formability by controlling the form of the sulfides, so it is preferable to add 0.0005% or more and 0.001% or more in accordance with need. Even if excessively added, there is no remarkable effect and the cost becomes high, so the upper limits of the Ca and Rem were made 0.005% and 0.02%.

N:

N, like C, is effective for causing the production of martensite, but simultaneously tends to cause the toughness and ductility of the steel material to deteriorate, so the amount is preferably made not more than 0.01%.

O:

O forms oxides and as an inclusion causes deterioration of the hole expansivity as represented by the formability of the steel material, particularly the elongated flange formability or the fatigue strength or toughness of the steel material, so is preferably controlled to not more than 0.01%.

Below, the method of production of the present invention will be explained.

Slab Reheating Temperature:

Steel adjusted to a predetermined composition is cast, then directly, or after being cooled once to the $Ar_3$ transformation temperature or less, then reheated, is hot-rolled. When the reheating temperature at this time is less than 1000° C., it becomes difficult to secure the predetermined finishing hot-rolling end temperature, so 1000° C. was made the lower limit of the reheating temperature.

Further, when the reheating temperature exceeds 1300° C., deterioration of the yield due to the production of scale at the time of heating is invited and simultaneously a rise in the production cost is invited, so 1300° C. was made the upper limit of the reheating temperature.

Even if the heated slab is heated locally or overall in the middle of the hot-rolling, there is no effect at all on the characteristics of the present invention.

Hot-Rolling Conditions:

The steel sheet is controlled to the predetermined microstructure and texture by the hot-rolling and subsequent cooling. The texture of the steel sheet finally obtained changes greatly due to the temperature region of the hot-rolling. If the hot-rolling end temperature TFE becomes less than $Ar_3$° C., the anisotropy ΔuE1 of uniform elongation exceeds 4% and the formability is remarkably deteriorated, so $$TFE \geqq Ar_3 (^\circ C.) \quad (1)$$

TFE is generally measured after the stand performing the final rolling in the hot-rolling, but when necessary it is also possible to use a temperature obtained by calculation.

Further, the upper limit of the hot-rolling end temperature is not particularly limited, but when over ($Ar_3$+180)° C., the surface properties declines due to the oxide layer produced at the surface of the steel sheet, so ($Ar_3$+180)° C. or less is preferable.

When severer surface properties are sought, it is preferable to make the TFE ($Ar_3$+150)° C. or less.

However, in the method of producing high-strength hot-rolled steel sheet having a microstructure comprised of ferrite or bainite as the phase of the largest volume percentage and excellent in shape fixability, regardless of the chemical composition of the steel sheet, when TFE becomes less than 800° C., the compressive load at the time of hot-rolling becomes too high and simultaneously the ductility anisotropy of the steel sheet becomes larger, so $$TFE \geqq 800^\circ C. \quad (1')$$

Further, when the finishing hot-rolling start temperature TFS is over 1100° C., the surface properties of the steel sheet remarkably drop, so $$TFS \leqq 1100^\circ C. \quad (2).$$

Further, when the difference between TFS and TFE is 120° C. or more, the texture does not sufficiently develop, both an excellent shape fixability and low anisotropy are achieved, and making the difference not more than 20° C. becomes difficult in operation, so $$20^\circ C. \leqq (TFS-TFE) \leqq 120^\circ C. \quad (4)$$

Here, in the method of production of a high-strength hot-rolled steel sheet having a microstructure including martensite in a volume percentage of 1 to 25% and excellent in shape fixability, the calculated residual strain Δϵ at the time of the end of the finishing rolling, the finishing hot-rolling start temperature TFS, and the finishing hot-rolled end temperature TFE shall satisfy the relation of the following (3). If this is not satisfied, a texture advantageous to the shape fixability is not formed during the hot-rolling:

$$\Delta\epsilon \geqq (TFS-TFE)/375 \quad (3)$$

Note that the Δϵ is found from the equivalent strain ϵi (i is 1 to n) given at each stand of the n stages of finishing rolling for the rolling, time ti (sec) (i=1 to n−1) between stands, time tn (sec) from the final stand to the start of cooling, rolling temperature Ti(K) (i=1 to n) at each stand, and a constant R=1.987.

$$\epsilon = \Delta\epsilon 1 + \Delta\epsilon 2 + \ldots + \Delta\epsilon n$$

$$\text{where, } \Delta\epsilon i = \epsilon i \times \exp\{-(ti^*/\tau n)^{2/3}\}$$

$$\tau i = 8.46 \times 10^{-9} \times \exp\{43800/R/Ti\}$$

$$ti^* = \tau n \times (ti/\tau i + t(i+1)/\tau(i+1) + \ldots + tn/\tau n\}$$

Further, in the hot-rolling of this method as well, the reduction ratio in the temperature range of $Ar_3$ to ($Ar_3$+150)° C. has a large effect on the formation of the texture of the final steel sheet. When the reduction ratio in this temperature range is less than 25%, the texture does not sufficiently develop and the finally obtained steel sheet does not exhibit a good shape fixability, so the lower limit of the reduction ratio in the temperature range of $Ar_3$ to ($Ar_3$+150)° C. was made 25%.

The higher the reduction ratio, the more the desired texture develops, so the reduction ratio is preferably made at least 50%. Further, if 75% or more, it is more preferable.

The upper limit of the reduction ratio is not particularly limited, but reduction by 99% or more results in a large load on the system and does not give any special effect, so the upper limit is preferably made less than 99%.

where, $$Ar_3 = 901 - 325 \times C\,\% + 33 \times Si\,\% + 287 \times P\,\% + 40 \times Al\,\% - 92 \times (Mn\,\% + Mo\,\% + Cu\,\%) - 46 \times Cr\,\% + Ni\,\%)$$

Even if performing the hot-rolling in this temperature range under ordinary conditions, the shape fixability of the final steel sheet is high, but when further improvement of the shape fixability is required, the friction coefficient is controlled to not more than 0.2 in at least one pass of the hot-rolling performed in this temperature range.

If the friction coefficient becomes more than 0.2, no particular difference occurs from ordinary hot-rolling, so 0.2 is made the upper limit of the friction coefficient.

On the other hand, the lower the friction coefficient, the harder the formation of the shear texture at the surface and the better the shape fixability, so the lower limit of the friction coefficient is not particularly limited, but if becoming less than 0.05, it becomes difficult to secure operational stability, so it is preferably that the coefficient be made at least 0.05.

Further, processing, spraying high pressure water, spraying fine particles, etc. for the purpose of descaling before hot-rolling are effective for raising the surface properties of the final steel sheet so are preferable.

Regarding the cooling after hot-rolling, controlling the coiling temperature is the most important, but making the average cooling rate at least 15° C./sec is preferable. The cooling is preferably started speedily after hot-rolling. Further, air cooling during the cooling also keeps the characteristics of the final steel sheet from deteriorating.

To pass on the austenite texture formed in this way to the final hot-rolled steel sheet, it is necessary to coil the sheet at not more than the critical temperature $T_0$ (° C.) shown by the following relation (5). Therefore, the $T_0$ (° C.) determined by the composition of the steel was made the upper limit of the coiling temperature.

This $T_0$ temperature is defined thermodynamically as the temperature at which the austenite and ferrite of the same composition as the austenite have the same free energy and can be simply calculated using the following relation (5) considering the effects of the components other than C.

The effect of components other than the components defined in the present invention as having an effect on the $T_0$ temperature is not that great so has been ignored here.

When the cooling is ended at above the temperature $T_0$ determined by the chemical composition of the steel material and the sheet is coiled up as it is, even if the above hot-rolling conditions had been satisfied, the desired texture is not sufficiently developed at the finally obtained steel sheet and the shape fixability of the steel sheet does not become high.

$$T_0=-650.4\times\{C\,\%/(1.82\times C\,\%-0.001)\}+B \quad (5)$$

where, B is found from the composition of the steel expressed by mass %, $$B=-50.6\times Mneq+894.3$$

$$Mneq=Mn\,\%+0.24\times Ni\,\%+0.13\times Si\,\%+0.38\times Mo\,\%+0.55\times Cr\,\%+0.16\times Cu\,\%-0.50\times Al\,\%-0.45\times Co\,\%+0.90\times V\,\%$$

When producing a high-strength hot-rolled steel sheet excellent in shape fixability, the microstructure of which has ferrite or bainite as the phase of the largest volume percentage, if the coiling temperature exceeds 700° C., securing a coiling temperature over the entire length of the coil becomes difficult and becomes a cause of variations in material quality. Further, when Ti, Nb, and/or V carbide forming elements are included, these carbides grow at the grain boundary and the ultimate deformability is remarkably impaired. Therefore, 700° C. was made the upper limit of the coiling temperature.

On the other hand, if the coiling temperature becomes less than 400° C., the austenite phase or martensite phase will be produced in a large amount in the steel sheet and the ultimate deformability will fall, so 400° C. was made the lower limit of the coiling temperature.

Further, when producing a high-strength hot-rolled steel sheet excellent in shape fixability, the microstructure of which includes martensite having a volume percentage of 1 to 25%, if the coiling temperature exceeds 400° C., no martensite phase is formed. Therefore, 400° C. was made the upper limit of the coiling temperature. From this viewpoint, the upper limit of the coiling temperature is preferably made 350° C., more preferably 300° C.

Note that to make the coiling temperature less than room temperature, not only is excessive capital investment required, but also no remarkable effect can be obtained, so it is preferable to make room temperature the lower limit of the coiling temperature.

Skin Pass Rolling:

Applying skin pass rolling to the steel of the present invention produced by the above method before shipment makes the shape of the steel sheet excellent. At this time, if the skin pass reduction ratio is less than 0.1%, the effect is small, so 0.1% was made the lower limit of the skin pass reduction ratio.

Further, for performing skin pass rolling exceeding 5%, an ordinary skin pass rolling machine has to be modified, economic demerits arise, and the formability of the steel sheet is remarkably deteriorated, so 5% is made the upper limit of the skin pass reduction ratio.

In addition, the yield ratio defined in the present invention is the ratio of the breakage strength (MPa) obtained in an ordinary JIS No. 5 Tensile Test and the yield strength (0.2% yield strength), that is, the yield ratio (YS/TS×100), and the ration is preferably not more than 70% from a view point of formability. Further, if the yield ratio is not more than 65%, it is possible to improve the shape fixability, so this is desirable.

Plating:

The type and method of plating are not particularly limited. The effect of the present invention may be obtained by any of electroplating, melt plating, vapor deposition plating, etc.

The steel sheet of the present invention can be used for bending, but also for composite forming comprised mainly of bending such as bending, punch stretch forming, restriction, etc.

EXAMPLES

Example

This is an example relating to high-strength hot-rolled steel sheet excellent in shape fixability, the microstructure of which has ferrite or bainite as the phase of the largest volume percentage.

The steel materials of A to K shown in Table 1 were heated to 1100 to 1270° C. and hot-rolled under the hot-rolling conditions shown in Table 2 to obtain hot-rolled steel sheets of 2.5 mm thicknesses. The results of various types of evaluations of hot-rolled steel sheets are shown in Table 3 to Table 4.

TABLE 1

| Steel type | C | Si | Mn | P | S | Al | Ti | Nb | V | Mo | Cr |
|---|---|---|---|---|---|---|---|---|---|---|---|
| A | 0.03 | 0.06 | 0.30 | 0.009 | 0.004 | 0.042 | | | | | |
| B | 0.04 | 0.32 | 0.54 | 0.012 | 0.005 | 0.045 | 0.13 | | | | |
| C | 0.06 | 0.83 | 1.32 | 0.010 | 0.006 | 0.036 | 0.11 | 0.033 | | | |
| D | 0.05 | 0.02 | 0.78 | 0.016 | 0.007 | 0.039 | | 0.010 | | | |

TABLE 1-continued

| | | | | | | | | | | |
|---|---|---|---|---|---|---|---|---|---|---|
| E | 0.04 | 0.03 | 0.82 | 0.011 | 0.005 | 0.028 | 0.13 | 0.021 | 0.01 | |
| F | 0.06 | 0.25 | 1.22 | 0.021 | 0.005 | 0.043 | 0.210 | 0.030 | | 0.05 |
| G | 0.07 | 0.11 | 0.98 | 0.013 | 0.006 | 0.036 | 0.18 | 0.040 | | |
| H | 0.08 | 0.68 | 1.36 | 0.014 | 0.008 | 0.042 | 0.35 | | 0.02 | |
| I | 0.09 | 0.62 | 1.10 | 0.009 | 0.004 | 0.031 | | 0.025 | | |
| J | 0.1 | 0.55 | 1.39 | 0.012 | 0.002 | 0.040 | | | | |
| K | 0.26 | 0.65 | 3.57 | 0.006 | 0.004 | 0.035 | 0.06 | 0.043 | | |

| Steel type | Cu | Ni | Co | B | N | O | Sn | Ca/Rem | Class |
|---|---|---|---|---|---|---|---|---|---|
| A | | | | | 0.0020 | 0.002 | 0.02 | | Inv. steel |
| B | | | | 0.0021 | 0.0019 | 0.004 | | | Inv. steel |
| C | | | | | 0.0038 | 0.003 | | Ca0.003 | Inv. steel |
| D | | | 0.07 | | 0.0022 | 0.003 | | | Inv. steel |
| E | | | | | 0.0030 | 0.002 | | | Inv. steel |
| F | | | | | 0.0023 | 0.002 | | | Inv. steel |
| G | 0.2 | 0.1 | | | 0.0018 | 0.001 | | | Inv. steel |
| H | | | | | 0.0031 | 0.003 | | Ca: 0.002 | Inv. steel |
| I | | | | | 0.0020 | 0.002 | | | Inv. steel |
| J | | | | | 0.0026 | 0.001 | | | Inv. steel |
| K | | | | | 0.0021 | 0.002 | | La0.0025 | Comp. steel |

The underlines show values outside the scope of the present invention.

TABLE 2

| No. | Steel | $Ar_3$ ° C. | $Ar_3$ + 150° C. | Reduction ratio *1 | TFS ° C. | TFE ° C. | TFS − TFE ° C. | Hot-rolling lubrication | $T_0$ ° C. | CT ° C. | Skin pass reduction ratio % | Type |
|---|---|---|---|---|---|---|---|---|---|---|---|---|
| 1 | A | 870 | 1020 | Good | 955 | 883 | 72 | No | 516 | 483 | 0.8 | Inv. ex. |
| 2 | B | 854 | 1004 | Good | 1020 | 970 | 50 | Yes | 504 | 495 | 0.5 | Inv. ex. |
| 3 | C | 792 | 942 | Good | 1015 | 920 | 95 | No | 462 | 450 | 0.8 | Inv. ex. |
| 4 | C | 792 | 942 | Good | 1000 | 892 | 108 | Yes | 462 | 455 | 0.8 | Inv. ex. |
| 5 | C | 792 | 942 | Good | 880 | 773 | 107 | No | 462 | 438 | 0.8 | Comp. ex. |
| 6 | C | 792 | 942 | Poor | 1107 | 989 | 118 | Yes | 462 | 530 | 0.8 | Comp. ex. |
| 7 | C | 792 | 942 | Good | 1050 | 855 | 195 | No | 462 | 455 | 0.8 | Comp. ex. |
| 8 | C | 792 | 942 | Poor | 1010 | 938 | 72 | No | 462 | 450 | 0.8 | Comp. ex. |
| 9 | C | 792 | 942 | Good | 930 | 880 | 50 | No | 462 | 580 | 0.8 | Comp. ex. |
| 10 | C | 792 | 942 | Good | 1017 | 888 | 129 | No | 462 | <200 | 0.8 | Comp. ex. |
| 11 | C | 792 | 942 | Poor | 980 | 890 | 90 | No | 462 | 150 | 0.8 | Comp. ex. |
| 12 | D | 826 | 976 | Good | 990 | 905 | 85 | No | 493 | 480 | 1.2 | Inv. ex. |
| 13 | D | 826 | 976 | Good | 890 | 803 | 87 | No | 493 | 467 | 0.8 | Comp. ex. |
| 14 | E | 818 | 968 | Good | 975 | 875 | 100 | No | 491 | 425 | 0.8 | Inv. ex. |
| 15 | E | 818 | 968 | Good | 905 | 730 | 175 | Yes | 491 | 400 | 0.8 | Comp. ex. |
| 16 | F | 783 | 933 | Good | 985 | 878 | 107 | Yes | 470 | 400 | 0.8 | Inv. ex. |
| 17 | G | 774 | 924 | Good | 955 | 860 | 95 | No | 482 | 478 | 0.8 | Inv. ex. |
| 18 | H | 778 | 928 | Good | 935 | 846 | 89 | No | 461 | 458 | 1.1 | Inv. ex. |
| 19 | I | 795 | 945 | Good | 920 | 863 | 57 | No | 476 | 465 | 0.8 | Inv. ex. |
| 20 | J | 761 | 811 | Good | 950 | 880 | 70 | Yes | 461 | 449 | 0.8 | Inv. ex. |
| 21 | K | 513 | 663 | Poor | 905 | 823 | 82 | No | 352 | 325 | 0.8 | Comp. ex. |

The underlines show values outside the scope of the present invention.
*1: Case where total of reduction ratios at temperature range of $Ar_3$° C. to ($Ar_3$ + 150)° C. of at least 25% indicated as "good" and other cases as "poor".

TABLE 3

| No. | Sample | Phase of largest. volume percentage | Largest phase volume percentage % | Rough carbide occupancy rate % | r-value of steel sheet rL | r-value of steel sheet rC | Anisotropy of elongation ΔuE1 | Anisotropy of elongation ΔLE1 | ΔLE1 − ΔuE1 | AI (MPa) | Type |
|---|---|---|---|---|---|---|---|---|---|---|---|
| 1 | A | Ferrite | 96 | <0.1 | 0.51 | 0.64 | 1.3 | 5.4 | 4.1 | 23 | Inv. ex. |
| 2 | B | Ferrite | 85 | <0.1 | 0.53 | 0.62 | 1.0 | 4.8 | 3.8 | 35 | Inv. ex. |
| 3 | C | Bainite | 78 | <0.1 | 0.51 | 0.61 | 0.8 | 4.5 | 3.7 | 30 | Inv. ex. |
| 4 | C | Ferrite | 98 | <0.1 | 0.58 | 0.66 | 2.4 | 3.8 | 1.4 | 18 | Inv. ex. |
| 5 | C | Ferrite | 96 | <0.1 | 0.43 | 0.56 | 5.3 | 4.8 | −0.5 | 42 | Comp. ex. |
| 6 | C | Ferrite | 95 | 0.2 | 0.86 | 0.92 | 2.4 | 0.8 | −1.6 | 25 | Comp. ex. |
| 7 | C | Ferrite | 89 | <0.1 | 0.73 | 0.77 | 3.8 | 3.5 | −0.3 | 30 | Comp. ex. |
| 8 | C | Ferrite | 97 | 0.8 | 0.78 | 0.93 | −0.5 | 1.2 | 1.7 | 18 | Comp. ex. |
| 9 | C | Ferrite | 67 | <0.1 | 0.82 | 0.86 | 1.8 | 1.3 | −0.5 | 12 | Comp. ex. |
| 10 | C | Ferrite | 89 | <0.1 | 0.85 | 0.72 | 5.2 | 4.3 | −0.9 | 0 | Comp. ex. |
| 11 | C | Ferrite | 78 | <0.1 | 0.73 | 0.78 | 2.3 | 1.7 | −0.6 | 28 | Comp. ex. |
| 12 | D | Ferrite | 72 | <0.1 | 0.58 | 0.66 | 1.8 | 3.8 | 2.0 | 43 | Inv. ex. |
| 13 | D | Ferrite | 68 | <0.1 | 0.51 | 0.63 | 4.6 | 4.2 | −0.4 | 29 | Comp. ex. |

TABLE 3-continued

| No. | Sample | Phase of largest. volume percentage | Largest phase volume percentage % | Rough carbide occupancy rate % | r-value of steel sheet rL | r-value of steel sheet rC | Anisotropy of elongation ΔuE1 | Anisotropy of elongation ΔLE1 | ΔLE1 − ΔuE1 | AI (MPa) | Type |
|---|---|---|---|---|---|---|---|---|---|---|---|
| 14 | E | Ferrite | 73 | 0.12 | 0.55 | 0.68 | 2.9 | 4.3 | 1.4 | 25 | Inv. ex. |
| 15 | E | Workedferrite | 78 | <0.1 | 0.56 | 0.73 | −2.3 | −1.2 | 1.1 | # | Comp. ex. |
| 16 | F | Ferrite | 71 | <0.1 | 0.57 | 0.61 | 2.3 | 4.3 | 3.3 | 35 | Inv. ex. |
| 17 | G | Ferrite | 68 | <0.1 | 0.58 | 0.66 | 2.6 | 4.9 | 2.3 | 27 | Inv. ex. |
| 18 | H | Ferrite | 77 | <0.1 | 0.51 | 0.61 | 2.5 | 5.8 | 3.3 | 38 | Inv. ex. |
| 19 | I | Bainite | 72 | <0.1 | 0.58 | 0.66 | 1.6 | 4.6 | 3.0 | 24 | Inv. ex. |
| 20 | J | Ferrite | 89 | <0.1 | 0.55 | 0.68 | 3.9 | 4.2 | 0.3 | 40 | Inv. ex. |
| 21 | K | Ferrite | 77 | <0.1 | 0.60 | 0.78 | 3.8 | 1.9 | −1.9 | 87 | Comp. ex. |

The underlines show values outside the scope of the present invention.
#: Shows that uniform elongation was less than 10% and measurement was not possible.

TABLE 4

(Continuation of Table 3)

| No. | Sample | {100}<011> to {223} <110> orient. comp. group X-ray mean intensity | {554} <225>, {111} <112>, {111} <110> X-ray mean intensity | {100} <011> X-ray intensity (A) | {211} <011> X-ray intensity (B) | (A) − (B) | Hole expansion ratio *2 | Eval. of shape fixability *3 | Type |
|---|---|---|---|---|---|---|---|---|---|
| 1 | A | 6.66 | 2.85 | 7.02 | 4.98 | 2.04 | Good | Good | Inv. ex. |
| 2 | B | 7.28 | 1.03 | 13.20 | 5.03 | 8.17 | Good | Good | Inv. ex. |
| 3 | C | 6.88 | 1.99 | 8.69 | 5.77 | 2.92 | Good | Good | Inv. ex. |
| 4 | C | 6.35 | 1.56 | 6.55 | 6.43 | 0.12 | Good | Good | Inv. ex. |
| 5 | C | 6.27 | 2.09 | 4.33 | 7.43 | −3.10 | Good | Good | Comp. ex. |
| 6 | C | 2.23 | 2.42 | 2.67 | 1.89 | 0.78 | Good | Poor | Comp. ex. |
| 7 | C | 5.43 | 1.38 | 4.35 | 6.92 | −2.57 | Good | Poor | Comp. ex. |
| 8 | C | 1.78 | 3.00 | 1.89 | 2.37 | −0.48 | Good | Poor | Comp. ex. |
| 9 | C | 1.96 | 1.03 | 2.23 | 2.02 | 0.21 | Poor | Poor | Comp. ex. |
| 10 | C | 4.36 | 1.56 | 3.89 | 6.35 | −2.46 | Poor | Good | Comp. ex. |
| 11 | C | 2.04 | 1.56 | 2.45 | 2.31 | 0.14 | Good | Poor | Comp. ex. |
| 12 | D | 5.10 | 2.09 | 6.02 | 4.31 | 1.71 | Good | Good | Inv. ex. |
| 13 | D | 4.62 | 2.44 | 4.22 | 5.22 | −1.00 | Good | Poor | Comp. ex. |
| 14 | E | 5.67 | 2.27 | 7.35 | 4.89 | 2.46 | Good | Good | Inv. ex. |
| 15 | E | 4.99 | 5.90 | 7.67 | 2.89 | 4.78 | Poor | Poor | Comp. ex. |
| 16 | F | 6.23 | 1.73 | 6.99 | 5.22 | 1.77 | Good | Good | Inv. ex. |
| 17 | G | 6.54 | 1.24 | 8.35 | 5.09 | 3.26 | Good | Good | Inv. ex. |
| 18 | H | 5.50 | 2.31 | 6.99 | 4.38 | 2.61 | Good | Good | Inv. ex. |
| 19 | I | 7.38 | 2.67 | 9.23 | 4.99 | 4.24 | Good | Good | Inv. ex. |
| 20 | J | 4.93 | 2.39 | 5.87 | 5.23 | 0.64 | Good | Good | Inv. ex. |
| 21 | K | 2.29 | 3.02 | 2.58 | 2.00 | 0.58 | Poor | Poor | Comp. ex. |

The underlines show values outside the scope of the present invention.
*2: Case satisfying $\lambda/TS \geqq 0.15$ indicated as "good" and other cases as "poor".
*3: Case satisfying $0 \leqq 1000/\rho \leqq (0.012 \times TS-4.5)$ indicated as "good" and case not satisfying it as "poor".

The shape fixability was evaluated using strip-shaped samples of 270 mm length×50 mm width×sheet thickness formed into hat shapes by a punch width of 78 mm, a punch shoulder R5 mm, a die shoulder R5 mm, and various wrinkle suppressing pressures, then measuring the amount of camber of the wall parts as the radius of curvature ρ(mm), and obtaining the reciprocal 1000/ρ. The smaller the 1000/ρ, the better the shape fixability.

In general, it is known that if the strength of a steel sheet rises, the shape fixability deteriorates. The inventors formed actual parts. From the results, when the 1000/ρ at a wrinkle suppressing pressure of 70 kN measured by the above method is 0 ($mm^{-1}$) or more and becomes (0.012×TS−4.5) ($mm^{-1}$) or less with respect to a tensile strength TS [MPa] of the steel sheet, an extremely excellent shape fixability is obtained.

Therefore, $0 \leqq 1000/\rho \leqq (0.012 \times TS-4.5)$ is evaluated as the condition for an excellent shape fixability.

Here, if the wrinkle suppressing pressure increases, the 1000/ρ tends to decrease. However, no matter which wrinkle suppressing pressure is selected, the order of the superiority of the shape fixability of the steel sheet does not change. Therefore, the evaluation of the wrinkle suppressing pressure 70 kN represents the shape fixability of the steel sheet well.

The hole expansivity is evaluated by the hole expansion ratio (following relation) of the hole diameter d (mm) to the initial hole diameter 10 mm at the time of punching a hole of a diameter of 10 mm in the center of a test piece of 100 mm a side, expanding the initial hole by a conical punch of a vertex of 60°, and allowing a crack to run through the steel sheet:

$$\lambda=\{(d-10)/10\}\times 100(\%)$$

The hole expansion ratio generally deteriorates when the strength of the steel sheet rises.

Therefore, (hole expansion ratio λ[%])/(tensile strength TS of steel sheet [MPa]) was used as the indicator of the hole expansivity and a value of 0.15 or more was evaluated as a good hole expansivity.

The r-value, the anisotropy of ductility, and the A.I. were measured using a JIS No. 5 tensile test piece. Further, the X-rays were measured by preparing a sample parallel to the sheet plane at a position of 7/16 the sheet thickness as a representative value of the steel sheet.

In Table 2, No. 5 to 11, No. 13, and No. 15 all had hot-rolling conditions outside the scope of the present invention, so the anisotropies of ductility were large, in some cases the shape fixability was also not sufficient, the elongated flange formabilities were also insufficient, and as a result high-strength steel sheets provided with a shape fixability, low anisotropy, and hole expansivity were not obtained.

No. 21 has composition and hot-rolling conditions all outside of the scope of the present invention, so was not satisfactory in shape fixability and hole expansivity.

When producing steels of chemical composition in the scope of the present invention by hot-rolling conditions in the scope of the present invention, it is learned that a good ductility anisotropy and hole expansivity and also a good shape fixability are obtained.

Example 2

This is an example relating to high-strength hot-rolled steel sheet excellent in shape fixability which has a multi-phase structure of a microstructure of ferrite or bainite as the phase of the largest volume percentage and includes martensite having a volume percentage of 1 to 25%.

The steel materials of A to L of the chemical composition shown in Table 5 were heated to 1100 to 1270° C. and hot-rolled under the hot-rolling conditions shown in Table 6 to obtain hot-rolled steel sheets of 2.5 mm thicknesses. The results of various types of measurements and evaluations are shown in Table 6 and Table 7 (continuation of Table 6).

The shape fixability was evaluated using strip-shaped samples of 270 mm length×50 mm width×sheet thickness formed into hat shapes by a punch width of 78 mm, a punch shoulder R5 mm, a die shoulder R5 mm, and various wrinkle suppressing pressures, then measuring the amount of warping of the wall parts as the radius of curvature ρ(mm), and obtaining the reciprocal 1000/ρ. The smaller the 1000/ρ, the better the shape fixability.

In general, it is known that if the strength of a steel sheet rises, the shape fixability deteriorates. The inventors formed actual parts. From the results, when the 1000/ρ at a wrinkle suppressing pressure of 70 kN measured by the above method is 0 ($mm^{-1}$) or more and becomes (0.012×TS−4.5) ($mm^{-1}$) or less with respect to a tensile strength TS [MPa] of the steel sheet, an extremely excellent shape fixability is obtained.

Therefore, $0 \leqq 1000/\rho \leqq (0.012 \times TS - 4.5)$ is evaluated as the condition for an excellent shape fixability.

Here, if the wrinkle suppressing pressure increases, the 1000/ρ tends to decrease. However, no matter which wrinkle suppressing pressure is selected, the order of the superiority of the shape fixability of the steel sheet does not change. Therefore, the evaluation of the wrinkle suppressing pressure 70 kN represents the shape fixability of the steel sheet well.

The r-value, the anisotropy of ductility, and the YR were measured using a JIS No. 5 tensile test piece. Further, the X-rays were measured by preparing a sample parallel to the sheet plane at a position of 7/16 the sheet thickness as a representative value of the steel sheet.

In Table 6 and Table 7, No. 2, 5, 7, 9 to 11, 13, 15, 17, 18, and 21 to 23 all had hot-rolling conditions and/or composition outside the scope of the present invention, so the anisotropies of ductility were large, in some cases the shape fixability was also not sufficient, and the YRs were also not satisfied, and as a result high-strength steel sheets provided with a shape fixability and low anisotropy were not obtained.

When producing steels of chemical composition in the scope of the present invention otherwise shown by hot-rolling conditions in the scope of the present invention, it is learned that a good ductility anisotropy, shape fixability, and YR are obtained.

TABLE 5

| | Chemical composition (mass %) | | | | | | | | | | | | |
|---|---|---|---|---|---|---|---|---|---|---|---|---|---|
| Symbol | C | Si | Al | Si + Al | Mn | Ni | Cr | Cu | Mo | W | Co | Sn | *1 |
| A | 0.03 | 0.02 | 0.040 | 0.060 | 1.10 | | | | | | | | 1.10 |
| B | 0.06 | 1.2 | 0.048 | 1.258 | 1.05 | | | | | | 0.1 | | 1.15 |
| C | 0.06 | 1.10 | 0.032 | 1.132 | 0.98 | 0.3 | | | | | | | 1.28 |
| D | 0.08 | 0.01 | 0.300 | 0.310 | 1.50 | | | | | | 0.4 | | 1.90 |
| E | 0.08 | 1.35 | 0.030 | 1.380 | 0.72 | 0.1 | | 0.2 | | | | | 1.02 |
| F | 0.11 | 0.09 | 0.045 | 0.135 | 1.80 | | | | 0.3 | | | | 2.10 |
| G | 0.07 | 1.25 | 0.035 | 1.285 | 0.75 | | | | | | | | 0.75 |
| H | 0.10 | 0.04 | 0.041 | 0.081 | 1.92 | | | | | | | | 1.92 |
| I | 0.11 | 0.29 | 0.520 | 0.810 | 2.54 | | | | | | | | 2.54 |
| J | 0.13 | 1.05 | 0.032 | 1.082 | 2.32 | | 0.5 | | | | | | 2.82 |
| K | 0.005 | 0.09 | 0.041 | 0.131 | 0.82 | | | | | | | 0.02 | 0.84 |
| L | 0.05 | 1.02 | 0.038 | 1.058 | 0.03 | | | | | | | | 0.03 |

| | Continued chemical composition (mass %) | | | | | | | | | | |
|---|---|---|---|---|---|---|---|---|---|---|---|
| Symbol | Nb | Ti | *2 | V | P | S | N | B | Ca | Rem | Remarks |
| A | 0.030 | | 0.03 | | 0.009 | 0.004 | 0.003 | | | | Inv. steel |
| B | | | | | 0.012 | 0.005 | 0.002 | 0.0008 | | | Inv. steel |
| C | 0.020 | 0.020 | 0.04 | | 0.010 | 0.002 | 0.003 | | | | Inv. steel |
| D | | | | | 0.012 | 0.003 | 0.003 | | 0.001 | | Inv. steel |
| E | 0.021 | | 0.021 | | 0.010 | 0.006 | 0.003 | | | 0.002 | Inv. steel |
| F | | | | | 0.009 | 0.001 | 0.002 | | | | Inv. steel |
| G | 0.018 | 0.082 | 0.1 | | 0.005 | 0.003 | 0.003 | | | | Inv. steel |
| H | 0.015 | 0.092 | 0.107 | | 0.012 | 0.001 | 0.003 | 0.0018 | | | Inv. steel |
| I | 0.012 | 0.011 | 0.023 | 0.01 | 0.011 | 0.002 | 0.002 | | 0.001 | | Inv. steel |
| J | | 0.020 | 0.02 | | | | | | | | Inv. steel |

TABLE 5-continued

| | | | | | | | |
|---|---|---|---|---|---|---|---|
| K | 0.029 | 0.029 | 0.022 | 0.006 | 0.003 | 0.001 | Comp. steel |
| L | | | | | | | Comp. steel |

The underlines show values outside the scope of the present invention.

*1: Mn + Ni + Cr + Cu + Mo + W + Co + Sn

*2: Nb + Ti

TABLE 6

| No. | Steel | $Ar_3$ ° C. | $Ar_3$ + 150° C. | Reduction ratio *1 | TFS ° C. | TFE ° C. | TFS − TFE ° C. | (TFS − TFE)/375 | Δε | Hot-rolling lub. | $T_0$ ° C. | CT ° C. | Skin pass red. ratio % | Type |
|---|---|---|---|---|---|---|---|---|---|---|---|---|---|---|
| 1 | A | 795 | 945 | Good | 940 | 870 | 70 | 0.19 | 0.42 | Yes | 476 | <200 | 0.5 | Inv. ex. |
| 2 | A | 795 | 945 | Good | 960 | 880 | 80 | 0.21 | 0.17 | Yes | 476 | <200 | 0.8 | Comp. ex. |
| 3 | B | 830 | 980 | Good | 1020 | 900 | 120 | 0.32 | 0.41 | Yes | 474 | 300 | 0.8 | Inv. ex. |
| 4 | C | 818 | 968 | Good | 940 | 870 | 70 | 0.19 | 0.41 | No | 474 | 250 | 0.8 | Inv. ex. |
| 5 | C | 818 | 968 | Good | 975 | 850 | 125 | 0.33 | 0.16 | No | 474 | <200 | 0.8 | Comp. ex. |
| 6 | D | 753 | 903 | Good | 930 | 865 | 65 | 0.17 | 0.37 | Yes | 476 | <200 | 0.5 | Inv. ex. |
| 7 | D | 753 | 903 | Good | 890 | 830 | 60 | 0.16 | 0.39 | No | 476 | 550 | 0.8 | Comp. ex. |
| 8 | E | 834 | 984 | Good | 940 | 880 | 60 | 0.16 | 0.39 | No | 488 | 250 | 0.8 | Inv. ex. |
| 9 | E | 834 | 984 | Poor | 945 | 860 | 86 | 0.23 | 0.25 | No | 488 | 250 | 0.8 | Comp. ex. |
| 10 | E | 834 | 984 | Good | 875 | 760 | 115 | 0.31 | 0.35 | No | 488 | 300 | 1.2 | Comp. ex. |
| 11 | E | 834 | 984 | Good | 1150 | 860 | 290 | 0.77 | 0.35 | No | 488 | 300 | 1.2 | Comp. ex. |
| 12 | F | 679 | 829 | Good | 875 | 805 | 70 | 0.19 | 0.33 | Yes | 439 | 250 | 0.8 | Inv. ex. |
| 13 | F | 679 | 829 | Poor | 960 | 870 | 90 | 0.24 | 0.21 | No | 439 | 250 | 1.2 | Comp. ex. |
| 14 | G | 853 | 1003 | Good | 980 | 900 | 80 | 0.21 | 0.28 | Yes | 489 | <200 | 1.2 | Inv. ex. |
| 15 | G | 853 | 1003 | Good | 890 | 820 | 70 | 0.19 | 0.28 | Yes | 489 | <200 | 1.0 | Comp. ex. |
| 16 | H | 698 | 848 | Good | 880 | 800 | 80 | 0.21 | 0.28 | No | 439 | <200 | 0.5 | Inv. ex. |
| 17 | H | 698 | 848 | Poor | 925 | 810 | 115 | 0.31 | 0.35 | No | 439 | 600 | 0.5 | Comp. ex. |
| 18 | H | 698 | 848 | Good | 930 | 800 | 130 | 0.35 | 0.42 | Yes | 439 | <200 | 0.5 | Comp. ex. |
| 19 | I | 665 | 815 | Good | 840 | 790 | 50 | 0.13 | 0.35 | Yes | 418 | <200 | 0.8 | Inv. ex. |
| 20 | J | 661 | 811 | Good | 840 | 800 | 40 | 0.11 | 0.2 | No | 399 | 250 | 1.0 | Inv. ex. |
| 21 | J | 661 | 811 | Poor | 870 | 790 | 80 | 0.21 | 0.23 | No | 399 | 510 | 1.0 | Comp. ex. |
| 22 | K | 835 | 985 | Good | 1135 | 875 | 260 | 0.69 | 0.45 | No | 452 | 250 | 1.0 | Comp. ex. |
| 23 | L | 916 | 1066 | Good | 1040 | 890 | 150 | 0.40 | 0.32 | No | 524 | 300 | 1.0 | Comp. ex. |

The underlines show values outside the scope of the present invention.

*1: Case of total of reduction ratios in temperature range of $Ar_3$° C. to ($Ar_3$ + 150)° C. indicated as "good" and other cases as "poor".

TABLE 7

(continuation of Table 6)

| No. | Steel | Max. value of vol. per. | Martensite vol. per. | r-value of steel sheet rL | r-value of steel sheet rC | Anisotropy of elongation ΔuE1 | Anisotropy of elongation ΔLE1 | ΔLE1 − ΔuE1 | {100}<011> to {223}<110> orient. comp. group x-ray mean intensity |
|---|---|---|---|---|---|---|---|---|---|
| 1 | A | Ferrite | 4.4 | 0.56 | 0.62 | 1.3 | 4.5 | 3.2 | 6.49 |
| 2 | A | Ferrite | 4.5 | 0.62 | 0.78 | 4.1 | 2.3 | −1.8 | 4.88 |
| 3 | B | Ferrite | 7.5 | 0.59 | 0.63 | 1.8 | 5.3 | 3.5 | 5.38 |
| 4 | C | Ferrite | 7.8 | 0.60 | 0.65 | 0.9 | 5.5 | 4.6 | 5.45 |
| 5 | C | Ferrite | 8.3 | 0.89 | 0.96 | 2.9 | 1.9 | −1.0 | 2.78 |
| 6 | D | Ferrite | 6.5 | 0.63 | 0.63 | 1.2 | 4.2 | 3.0 | 6.49 |
| 7 | D | Ferrite | 0 | 0.77 | 1.00 | 2.2 | 1.5 | −0.7 | 1.95 |
| 8 | E | Ferrite | 4.9 | 0.59 | 0.66 | 1.3 | 4.3 | 3.0 | 5.05 |
| 9 | E | Ferrite | 6.3 | 0.82 | 0.96 | 1.3 | 1.1 | −0.2 | 2.35 |
| 10 | E | Bainite | 8.4 | 0.63 | 0.75 | 5.3 | 4.6 | −0.7 | 4.59 |
| 11 | E | Ferrite | 6.3 | 0.65 | 0.73 | 4.8 | 3.2 | −1.6 | 6.33 |
| 12 | F | Ferrite | 7.5 | 0.55 | 0.62 | 1.1 | 4.5 | 3.4 | 7.08 |
| 13 | F | Ferrite | 7.6 | 0.88 | 0.92 | 1.9 | 1.5 | −0.4 | 1.78 |
| 14 | G | Ferrite | 5.8 | 0.59 | 0.63 | 1.2 | 4.6 | 3.4 | 3.71 |
| 15 | G | Ferrite | 9.8 | 0.65 | 0.75 | 4.7 | 6.5 | 1.8 | 4.14 |
| 16 | H | Bainite | 10.2 | 0.66 | 0.66 | 2.1 | 5.3 | 3.2 | 6.88 |
| 17 | H | Ferrite | 0.2 | 0.78 | 1.09 | 1.9 | 1.3 | −0.6 | 1.95 |
| 18 | H | Ferrite | 11.8 | 0.61 | 0.82 | 1.7 | 1.1 | −0.6 | 6.64 |
| 19 | I | Bainite | 12.5 | 0.53 | 0.53 | 1.4 | 4.9 | 3.5 | 6.37 |
| 20 | J | Bainite | 15.3 | 0.56 | 0.59 | 0.0 | 5.1 | 5.1 | 6.51 |
| 21 | J | Bainite | 0 | 1.00 | 0.99 | 2.5 | 1.5 | −1.0 | 2.12 |

TABLE 7-continued (continuation of Table 6)

| | | | | | | | | | |
|---|---|---|---|---|---|---|---|---|---|
| 22 | K | Ferrite | 0 | 0.59 | 0.77 | 5.6 | 3.2 | −2.4 | 4.58 |
| 23 | L | Ferrite | 0 | 0.89 | 1.02 | 6.2 | 1.9 | −4.3 | 1.38 |

| No. | {554}<225>, {111}<112>, {111}<110> X-ray mean intensity | {100}<011> X-ray intensity (A) | {211}<011> X-ray intensity (B) | (A) − (B) | YR % | Eval. of shape fixability *2 | Type |
|---|---|---|---|---|---|---|---|
| 1 | 2.95 | 6.82 | 5.92 | 0.90 | 59% | Good | Inv. ex. |
| 2 | 0.83 | 3.89 | 5.62 | −1.73 | 62% | Good | Comp. ex. |
| 3 | 1.67 | 6.12 | 4.36 | 1.76 | 56% | Good | Inv. ex. |
| 4 | 1.96 | 5.95 | 4.59 | 1.36 | 61% | Good | Inv. ex. |
| 5 | 1.98 | 2.15 | 3.65 | −1.50 | 60% | Poor | Comp. ex. |
| 6 | 2.85 | 7.37 | 5.68 | 1.69 | 65% | Good | Inv. ex. |
| 7 | 1.22 | 2.13 | 1.23 | 0.90 | 85% | Poor | Comp. ex. |
| 8 | 2.92 | 6.55 | 4.92 | 1.63 | 63% | Good | Inv. ex. |
| 9 | 0.89 | 2.05 | 2.55 | −0.50 | 63% | Poor | Comp. ex. |
| 10 | 4.52 | 5.13 | 4.00 | 1.13 | 64% | Good | Comp. ex. |
| 11 | 1.82 | 4.95 | 7.33 | −2.38 | 65% | Good | Comp. ex. |
| 12 | 1.23 | 8.30 | 6.58 | 1.72 | 62% | Good | Inv. ex. |
| 13 | 1.75 | 2.15 | 1.50 | 0.65 | 59% | Poor | Comp. ex. |
| 14 | 2.85 | 4.92 | 3.02 | 1.90 | 60% | Good | Inv. ex. |
| 15 | 4.56 | 4.79 | 3.85 | 0.94 | 69% | Good | Comp. ex. |
| 16 | 1.81 | 7.99 | 4.99 | 3.00 | 59% | Good | Inv. ex. |
| 17 | 2.23 | 1.35 | 2.25 | −0.90 | 89% | Poor | Comp. ex. |
| 18 | 1.53 | 5.12 | 7.85 | −2.73 | 63% | Poor | Comp. ex. |
| 19 | 2.78 | 6.93 | 5.55 | 1.38 | 62% | Good | Inv. ex. |
| 20 | 2.65 | 6.99 | 5.88 | 1.11 | 68% | Good | Inv. ex. |
| 21 | 2.23 | 2.29 | 2.00 | 0.29 | 92% | Poor | Comp. ex. |
| 22 | 1.89 | 3.87 | 5.21 | −1.34 | 75% | Good | Comp. ex. |
| 23 | 2.36 | 1.36 | 1.47 | −0.11 | 78% | Poor | Comp. ex. |

The underlines show values outside the scope of the present invention.
*1: Case satisfying $0 \leqq 1000/\rho \leqq (0.012 \times TS-4.5)$ indicated as "good" and case not satisfying it as "poor".

INDUSTRIAL APPLICABILITY

As explained above, according to the present invention, it becomes possible to provide thin steel sheet with little spring back, excellent in shape fixability, and simultaneously having press formability with little anisotropy, becomes possible to use high-strength steel sheet even for parts for which use of high-strength steel sheet was difficult in the past due to the problem of poor shape, simultaneously becomes possible to achieve both safety of the automobile and reduced weight of the automobile, and becomes possible to contribute greatly to auto production meeting the demands of the environment and society such as the reduction of the emission of $CO_2$. Therefore, the present invention is an invention with extremely high value industrially.

The invention claimed is:

1. A method of producing a high-strength hot-rolled steel sheet excellent in shape fixability comprising the following steps, hot-rolling a cast slab as cast or cooled once, said cast slab containing, in terms of weight %, C: 0.02 to 0.3%, at least one or more element selected from the group consisting of, total 0.1 to 3.5%, in terms of weight %, Mn: 0.05 to 3%, Ni: 3% or less Cr: 3% or less, Cu: 3% or less, Mo: 1% or less, Co: 3% or less and Sn: 0.2% or less, at least one or both of, total 0.02 to 3% in terms of weight %, Si: 3% or less and Al: 3% or less and remainder Fe and unavoidable impurities, then reheated to a range of 1000 to 1300° C., with a total reduction ratios of 25% or more at $Ar_3$ to $(Ar_3+150)$° C., temperature at finishing hot-rolling start, TFS, and temperature at finishing hot-rolling end, TFE, and calculated residual strain $\Delta\epsilon$ to simultaneously satisfy following relations (1) to (4), and cooling hot-rolled steel sheet, then coiling at below critical temperature $T_0$ determined by the chemical composition of the steel shown in the following relation (5) and a temperature of not more than 400° C.:

$$TFE \geqq Ar_3\ (°\ C.) \quad (1)$$

$$TFS \leqq 1100°\ C. \quad (2)$$

$$\Delta\epsilon \geqq (TFS-TFE)/375 \quad (3)$$

$$20°\ C. \leqq (TFS-TFE) \leqq 120°\ C. \quad (4)$$

$$T_0 = -650.4 \times \{C\ \%/(1.82 \times C\ \% - 0.001)\} + B \quad (5)$$

where, B is found from the composition of the steel expressed by weight %, $$B = -50.6 \times \mathrm{Mn}eq + 894.3$$

$$\mathrm{Mn}eq = \mathrm{Mn}\ \% + 0.24 \times \mathrm{Ni}\ \% + 0.13 \times \mathrm{Si}\ \% + 0.38 \times \mathrm{Mo}\ \% + 0.55 \times \mathrm{Cr}\ \% + 0.16 \times \mathrm{Cu}\ \% - 0.50 \times \mathrm{Al}\ \% - 0.45 \times \mathrm{Co}\ \% + 0.90 \times \mathrm{V}\ \%$$

where, $$\mathrm{Ar}_3 = 901 - 325 \times \mathrm{C}\ \% + 33 \times \mathrm{Si}\ \% + 287 \times \mathrm{P}\ \% + 40 \times \mathrm{Al}\ \% - 92 \times (\mathrm{Mn}\ \% + \mathrm{Mo}\ \% + \mathrm{Cu}\ \%) - 46 \times (\mathrm{Cr}\ \% + \mathrm{Ni}\ \%)$$

$\Delta\epsilon$ is found from the equivalent strain $\epsilon i$ (i is 1 to n) given at each stand of the n stages of finishing rolling for the rolling, time ti (sec) (i=1 to n−1) between stands, time tn (sec) from the final stand to the start of cooling, rolling temperature Ti(K) (i=1 to n) at each stand, and a constant R=1.987, $$\epsilon = \Delta\epsilon 1 + \Delta\epsilon 2 + \ldots + \Delta\epsilon n$$

$$\text{where, } \Delta\epsilon i = \epsilon i \times \exp\{-(\mathrm{ti}^*/\tau n)^{2/3}\}$$

$$\tau n = 8.46 \times 10^{-9} \times \exp\{43800/\mathrm{R}/\mathrm{Ti}\}$$

$$\mathrm{ti}^* = \tau n \times (\mathrm{ti}/\tau i + t\,(i+1)/\tau(i+1) + \ldots + tn/\tau n\}.$$

2. A method for producing a high-strength hot-rolled steel sheet excellent in shape fixability according to claim 1, characterized by said cast slab containing, in terms of weight %, at least one or more element selected from Nb, Ti and V with a total of 0.001 to 0.8%, in terms of weight %.

3. A method for producing a high-strength hot-rolled steel sheet excellent in shape fixability according to claim 1 or 2, characterized by said cast slab further containing at the least of one or more element selected from the group consisting of, in terms of weight %, P: 0.2% or less, B: 0.01% or less, Ca: 0.0005to 0.005% and Rem: 0.001 to 0.02%.

4. A method of producing a high-strength hot-rolled steel sheet excellent in shape fixability according to claim 1 or 2, characterized by further controlling a friction coefficient to not more than 0.2 in at least one pass in the hot-rolling in a temperature range of $\mathrm{Ar}_3$ to $(\mathrm{Ar}_3+150)°$ C.

5. A method of producing a high-strength hot-rolled steel sheet excellent in shape fixability characterized by applying skin pass rolling of 0.1 to 5% to hot-rolled steel sheet produced by the method of producing a high-strength hot-rolled steel sheet excellent in shape fixability according to claim 1 or 2.

6. A high-strength hot-rolled steel sheet excellent in shape fixability produced by the method described in claim 1 or 2, wherein ferrite or bainite is the maximum phase in terms of percent volume, satisfying all of the following at least at ½ of the sheet thickness:

(1) a mean value of X-ray random intensity ratios of a group of {100}<011> to {223}<110> orientations is 2.5 or more, (2) a mean value of X-ray random intensity ratio of three orientations of {554}<225>, {111 }<112>, {111}<110> is 3.5 or less, (3) X-ray random intensity ratio of {100}<011> is larger than that of {211}<011>, (4) X-ray random intensity ratio of {100}<011>is 2.5 or more, having at least one of an r-value in a rolling direction and the r-value in a direction perpendicular to the rolling direction is 0.7 or less, having anisotropy of uniform elongation ΔuE1 is 4% or less, having an anisotropy of local elongation ΔLE1 is 2% or more, and having an ΔuE1 which is ΔLE1 or less, where:

$$\Delta uE1 = \{|uE1(L) - uE1(45°)| + |uE1(C) - uE1(45°)|\}/2$$

$$\Delta LE1 = \{|LE1(L) - LE1(45°)| + |LE1(C) - LE1(45°)|\}/2$$

uE1(L): Uniform elongation in a rolling direction uE1(C): Uniform elongation in a transverse direction uE1(45°): Uniform elongation in a 45° direction LE1(L): Local elongation in a rolling direction LE1(C): Local elongation in a transverse direction LE1(45°): Local elongation in a 45° direction.

7. A high-strength hot-rolled steel sheet excellent in shape fixability according to claim 6, characterized in that an occupancy rate of iron carbide, diameter of which is 0.2 μm or more, is 0.3% or less.

8. A high-strength hot-rolled steel sheet excellent in shape fixability according to claim 6, characterized in that an aging index AI is 8 MPa or more.

9. A high-strength hot-rolled steel sheet excellent in shape fixability according to claim 6, wherein ferrite or bainite is the maximum phase in terms of percent volume, and a percent volume of martensite is 1 to 25%.

10. A high-strength hot-rolled steel sheet excellent in shape fixability according to claim 6, wherein the steel sheet is plated.

* * * * *